US009888799B2

(12) United States Patent
Andrieux et al.

(10) Patent No.: US 9,888,799 B2
(45) Date of Patent: Feb. 13, 2018

(54) BOTTLE HOLDER

(71) Applicant: OXSITIS, Clemont-Ferrand (FR)

(72) Inventors: Fabien Andrieux, Clermont-Ferrand (FR); Magali Cornette, Montagny les Lanches (FR)

(73) Assignee: OXSITIS, Clermont-Ferrand (FR)

( * ) Notice: Subject to any disclaimer, the term of this patent is extended or adjusted under 35 U.S.C. 154(b) by 0 days.

(21) Appl. No.: 14/913,937

(22) PCT Filed: Sep. 10, 2014

(86) PCT No.: PCT/FR2014/052233
§ 371 (c)(1),
(2) Date: Feb. 23, 2016

(87) PCT Pub. No.: WO2015/036689
PCT Pub. Date: Mar. 19, 2015

(65) Prior Publication Data

US 2016/0206123 A1 Jul. 21, 2016

(30) Foreign Application Priority Data

Sep. 12, 2013 (FR) ..... 13 02123

(51) Int. Cl.

| | |
|---|---|
| ***A47J 41/00*** | (2006.01) |
| ***A47G 23/02*** | (2006.01) |
| ***A45F 5/00*** | (2006.01) |
| ***A45C 13/02*** | (2006.01) |
| *B65D 25/20* | (2006.01) |
| *A45F 5/02* | (2006.01) |

(52) U.S. Cl.
CPC ..... *A47G 23/0241* (2013.01); *A45C 13/02* (2013.01); *A45F 5/00* (2013.01); *A45C 2013/026* (2013.01); *A45C 2200/20* (2013.01); *A45F 5/021* (2013.01); *A45F 2200/0583* (2013.01)

(58) Field of Classification Search
CPC ..... A47G 23/0241; A47G 2023/0275; A45F 5/00; A45F 5/021; A45F 2200/0583; A45C 13/02; A45C 2013/026; A45C 2200/20
USPC ..... 220/737, 739, 918, 919, 920; 215/395; 206/523
See application file for complete search history.

(56) References Cited

U.S. PATENT DOCUMENTS 2,351,107 A * 6/1944 Charnysh ..... G01K 1/083 206/306
2,500,786 A * 3/1950 Austin ..... A61J 9/08 126/261
2,706,571 A * 4/1955 Ryan ..... A61J 9/08 215/11.6
2,979,246 A * 4/1961 Liebeskind ..... B31B 7/00 156/245
4,681,239 A * 7/1987 Manns ..... B65D 81/3879 215/12.1

(Continued)

*Primary Examiner* — J. Gregory Pickett
*Assistant Examiner* — Niki M Eloshway
(74) *Attorney, Agent, or Firm* — Dowell & Dowell, P.C.

(57) ABSTRACT

The bottle holder (2) comprises a pocket (3) provided with an insertion opening (5) designed to receive a bottle (4) in the pocket (3) of the bottle holder, the opening of the pocket (3) having the same dimensions as the cross section (D) of the pocket (3). At least two removable wedging members (11, 12) are mounted on at least part of the inner surface (13) of the pocket.

8 Claims, 2 Drawing Sheets

(56) References Cited

U.S. PATENT DOCUMENTS

Figure 1:
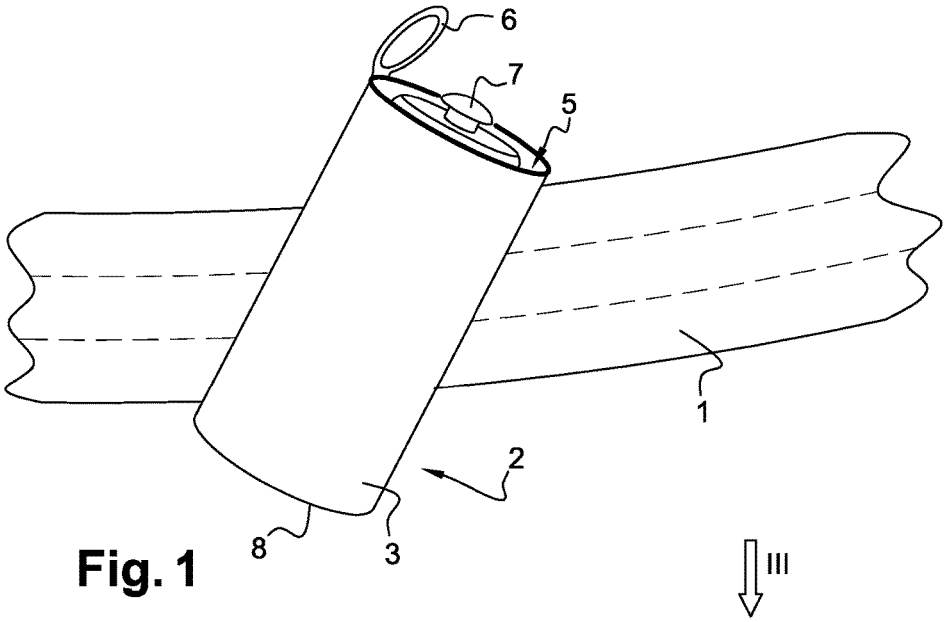

| | | | | |
|---|---|---|---|---|
| 4,880,119 | A * | 11/1989 | Simon | B65D 81/09 206/584 |
| 4,964,529 | A * | 10/1990 | Houston | F17C 13/084 206/523 |
| 5,570,824 | A | 11/1996 | Lyon et al. | |
| 8,608,018 | B2 * | 12/2013 | Babinsky | B65D 81/3869 206/737 |
| 2004/0084461 | A1 * | 5/2004 | Eisenbraun | B60N 3/108 220/739 |
| 2009/0302081 | A1 | 12/2009 | Kriesel | |
| 2013/0000257 | A1 | 1/2013 | Waltrip | |
| 2013/0240549 | A1 * | 9/2013 | Beggins | B65D 21/086 220/739 |

* cited by examiner

BOTTLE HOLDER

The present invention relates to a bottle holder.

A bottle holder comprises a main body forming a pocket suitable for receiving a bottle inserted from an opening formed in the pocket. The bottle holder is used to transport a bottle, that is to say a flexible or rigid container designed to receive a product, which is generally liquid. The bottle holder is used, for example, in the field of outdoor human activities, such as sporting activities like running, trail-running, cycling, mountain biking, cross-country skiing, rambling or snowshoeing. The bottle holder is designed to be fixed, in a permanent or removable manner, to a belt, to a harness, to backpack straps or to an item of clothing.

The user of the bottle holder must be able to have access to the bottle holder, and therefore to the bottle, at any time without having to interrupt his activity and in particular without it being necessary for the user to look at the bottle holder, For example, a runner must be able to grab the bottle blindly, take it out of the bottle holder, use it and return it to the bottle holder without interrupting his running. Consequently, grabbing the bottle and returning it to the bottle holder must be straightforward and guided while ensuring that the bottle is retained optimally when it is in place in the bottle holder.

FR-A-2 783 140 discloses a bottle holder whose opening is configured as a funnel, which facilitates removal and insertion of the bottle into the bottle holder without it being necessary to look at the bottle holder. Such a bottle holder serves to guide the bottle, in particular when it is inserted into the bottle holder. On the other hand, it does not allow optimum retention of any type of bottle inserted into the bottle holder. U.S. Pat. No. 5,890,636 also discloses a bottle holder provided on its inner surface with a self-gripping band intended to cooperate with a self-gripping band fixed to a bottle. Here, the bottle holder is therefore specifically associated with one bottle. U.S. Pat. No. 5,570,824 describes a bottle holder which serves to retain a bottle by means of an elastic band surrounding the neck of the bottle. Such solutions do not make it possible to readily retain any type of bottle while facilitating placement and removal of the bottle by the user using one hand.

The invention is aimed more particularly at overcoming these disadvantages by providing a bottle holder serving to optimally retain any type of bottle inserted into the bottle holder while facilitating the insertion of said bottle into the bottle holder and the taking-hold of said bottle in the bottle holder.

To this end, the subject of the invention is a bottle holder comprising a pocket provided with an insertion opening designed to receive a bottle in the pocket of the bottle holder, the opening of the pocket having the same dimensions as the cross section of the pocket, characterized in that at least two removable wedging members are mounted on part of the inner surface of the pocket.

With such a pocket, extended by an opening having the same dimensions as the pocket, it is readily possible to insert and remove a bottle from the pocket, whatever its diameter when said bottle is cylindrical with a circular base, the pocket having dimensions sufficient to receive bottles of different diameters or dimensions in the case of bottles with a noncircular cross section, for example a rectangular, triangular or oval cross section. Specifically, the retention in the pocket of bottles with dimensions smaller than that of the pocket is ensured by the wedging members which, being removable, are readily adaptable to the geometry of the bottle.

According to advantageous but nonobligatory aspects of the invention, such a bottle holder may comprise one or more of the following features:

- Two wedging members are configured as continuous rings.
- The wedging members configured as rings have the same height.
- The wedging members configured as rings have different heights.
- Another removable wedging member is inserted into the pocket when the two wedging members configured as continuous rings are in place in the pocket.
- The third wedging member has a shape adapted to define, once in place in the internal volume of the pocket, a volume for the reception of a bottle, said volume being less than the initial volume of the pocket.
- The this wedging member is provided, on its outer surface, with housings for the reception of the two other wedging members configured as rings.
- The third wedging member is provided, at an open end, with an edge with a return adapted to co a removable manner the edge of the opening of the pocket when the third wedging member is in place in the pocket.
- The pocket of the bottle holder is provided with an open bottom.
- At least one strap is fixed in the open bottom of the pocket.
- The pocket of the bottle holder is provided with a closed bottom.

Figure 2:
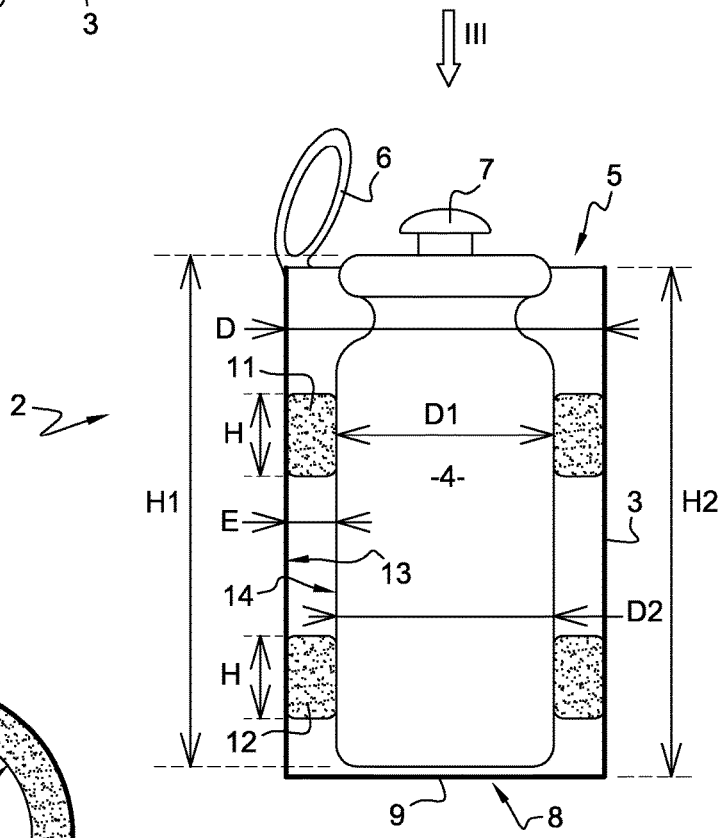
Figure 3:
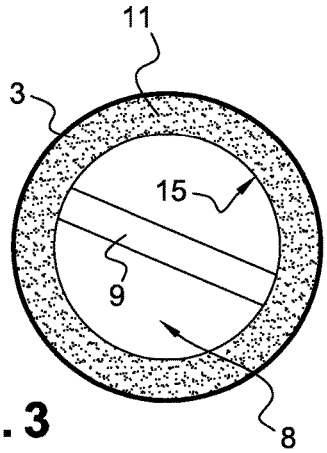
Figure 4:
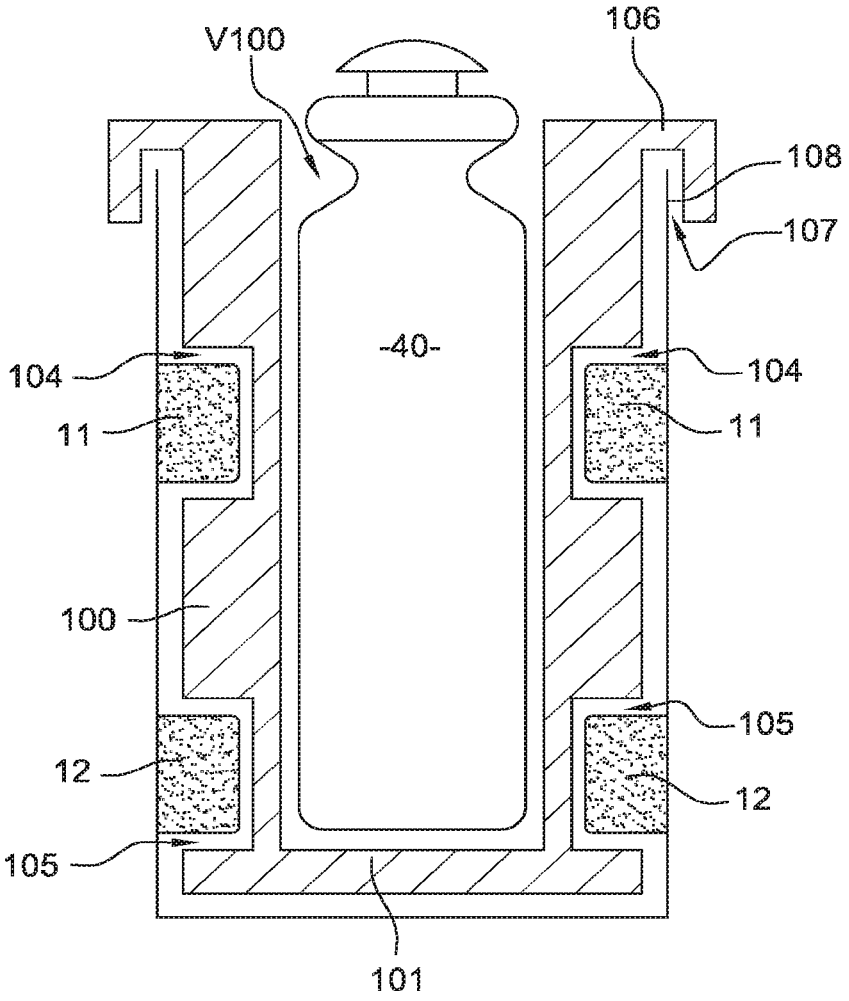

The invention win be better understood and other advantages thereof will become more clearly apparent on reading the description of a number of embodiments of the invention that is given by way of nonlimiting example and with reference to the following drawings, in which:

FIG. 1 is a perspective view of a bottle holder, with a bottle inserted into the bottle holder, according to one embodiment of the invention in position on a partially illustrated belt, FIG. 2 is a view in section, on another scale, of the bottle holder of FIG. 1, a bottle seen from the side being illustrated in place in the bottle holder, the belt not being represented, FIG. 3 is a top view of the bottle holder of FIG. 1, without the bottle and on another scale, and FIG. 4 is a view in section, similar to FIG. 2 and on another scale, of another embodiment of the invention, FIG. 1 illustrates a belt 1 known per se and intended to equip a person involved in a sporting activity such as running or trail-running. In the example, the belt 1 is equipped with one bottle holder 2. In a variant, is provided with a plurality of bottle holders 2. The bottle holder 2 is fixed, in a permanent or removable manner, on the belt 1 by means known per se. These means are, for example, press studs, a self-gripping band, a loop for the belt or stitches. The bottle holder 2 comprises a pocket 3 forming the main body of the bottle holder 2. The pocket 3 is made of a strong lightweight weatherproof material. The material is, for example, a textile made of polymers which is reinforced by a core, for example likewise made of a polymer other than that of the textile. in a variant, the core of the pocket may be made of a rigid material.

In the example, the pocket 3 is cylindrical with a circular base, it being understood that it can have another shape, for example a rectangular shape. The height of the cylinder constituting the pocket 3 is between 1 cm and 30 cm, advantageously close to 15 cm. The diameter of the pocket is between 1 cm and 15 cm, advantageously dose to 7 cm.

Such dimensions allow the pocket 3 to receive a bottle 4 having standard dimensions, namely a cylindrical bode, for example with a circular base, with a capacity standardly dose to 200 ml to 500 ml, with the knowledge that such a pocket has dimensions adapted to receive a bode with a capacity standardly available on the market, namely between 100 ml and 1000 ml. The pocket 3 is also adapted to receive bottles which are cylindrical or noncylindrical with a rectangular, oval or triangular cross section, The bottle is made of a rigid material, for example of polymers, of metal such as aluminum or of glass. In a variant, it is made of a flexible or semirigid material for flask-type bottles made of polymers, in the text which follows, reference will be made to a bode made of rigid material.

The opening 5 of the pocket 3 has the same shape and the same nominal dimensions as the cross section of the pocket 3. In this case, the opening 5 is circular and of the same diameter, Such a configuration of the pocket 3 and its opening 5 allows the bottle 4 to be easily inserted into and removed from the pocket 3, even blindly by a user. Specifically, the overdimensioning of the pocket 3, and de facto of the opening 5, with respect to the bottle 4 ensures that the bottle 4 can be easily taken hold of and guided in the bottle holder 2. The user can not only easily insert a bode 4, which is in all cases always smaller than the opening 5, into the pocket 3 but also insert his hand, or at least part of his finders, into the pocket 3 to grab the bottle 4 in order to remove it.

A link 6, advantageously made of an elastic. material, is fixed to the edge of the opening 5. in the example, it is configured as a loop and intended to retain, in a removable manner, the end-piece 7 of the bottle 4. in a variant, which is not illustrated, the link comprises a member for tightening the loop, in the manner of a running knot, The bottle holder 2 is advantageously mounted inclined with respect to the vertical on the belt 1, as shown in FIG. 1 Thus, the opening 5 of the pocket 3 is advantageously oriented in the direction of the user's chest, making it easier to take hold of the bottle 4 and to insert it. In another embodiment, the opening 5 is inclined in the direction of the users back.

The end of the pocket opposite to the opening 5 forms the bottom 8 of the pocket 3, As can be seen in FIG. 3, this bottom is open. In one embodiment, which is not illustrated, the bottom is solid. A strap 9 is fixed, here diametrically, in the bottom 8, thus preventing the bottle 4 from coming out through the bottom 8. In one embodiment, which is not illustrated, the bottom 8 is equipped with two straps 9, for example arranged cross vise, An open bottom 8 allows outward flow of any liquids present in the pocket 3. Moreover, if the strap 9 equipping the bottom is made of an elastic material, as in one preferred embodiment, that allows of adaptation of the pocket 3 to the length of the bottle 4. Specifically, said bottle can thus protrude to a greater or lesser degree from the holder 2 while being retained therein, without the risk of coming out accidentally.

Moreover, the presence of an elastic strap 9 also participates in laterally retaining the bottle 4 when it is in pace in the pocket 3, Specifically, owing to the relative flexibility of the latter, in the illustrated embodiment the elastic return force of the strap 9 has a tendency to draw in the bottom 8 around the bottom 10 of the bottle 4.

Holding the bottle 4 in place in the pocket 3 is optimized by at least one wedging member, in this case, the pocket 3 is equipped with two wedging members 11, 12. These wedging members 11, 12 are configured as rings, which are continuous in the example, fixed on the inner surface 13 of the pocket 3. In one embodiment, they are fixed in a permanent manner, for example by stitching or adhesive bonding, on the surface 13. Advantageously, they are fixed in a removable manner on the surface 13 so as to be readily movable on the surface 13 over the height H2 of the pocket 3. Moreover, removable wedging members 11, 12 can be easily withdrawn from the pocket 3, for example to be replaced by other wedging members having dimensions and/or shapes adapted to another type of bottle 4. Such a fixing is carded out by techniques known per se, for example by self-gripping bands or by adhesive bonding with nonpolymerizing adhesives.

The rings 11, 12 are made of a lightweight elastic deformable material, for example a polymer-based cellular foam. Advantageously, the material is one with a shape memory. Such a configuration makes it possible to deform the rings 11, 12 by crushing and in a reversible manner. It is thus possible to vary the useful internal diameter D1 of the pocket 3.

The useful diameter D1 is thus always less than or, at most, close to the nominal diameter D of the pocket 3 and the opening 5. The diameter D1 can thus vary by a value corresponding substantially to the thickness E of the rings 11, 12, This variation is induced by the dimensions of the bottle 4. In other words, the useful internal diameter D1 corresponds to the external diameter D2 of the bottle 4. The diameter D1 is slightly less than the diameter D2 so as to retain the bottle 4 in position in the pocket 3 by the rings 11, 12 bearing in an immobilizing manner on the outer surface 14 of the bottle 4.

In one embodiment, which is not illustrated, unlike the embodiment of FIG. 2, the rings 11, 12 do not have the some height H. The ring 11 situated closer to the opening 5 has, for example, a height greater than the height of the ring 12 arranged in the vicinity of the bottom 10 of the bottle 4. In a variant, the ring situated closer to the bottom is the one which has the greater height.

In one embodiment, which is not illustrated and not claimed, a single ring, if need be with a height greater than the height H of the rings 11, 12 illustrated in FIG. 2, is used, A single ring is advantageously used when the bottle has a height H1 which is much less than the height H2 of the pocket 3. It is then necessary to retain such a bottle in the vicinity of the opening 5 without it bearing on the strap 9, in order to allow it to be easily taken hold of by the user.

In a variant, which is not illustrated, a set of rings of different heights H and/or thicknesses E is provided with the bottle holder 1 so that the user can readily adapt the wedging to the bottle(s) which he wishes to use with his bottle holder(s). It is clear that a set of different wedging members 11, 12 adapted to be connected to one another and to the inner surface of the pocket allows the use of the bottle holder with a bottle of any type and/or dimensions.

Advantageously, in order to optimize the contact between the wedging member 11, 12 and the surface 14 of the bottle 4, the rings 11,12 comprise, at least on the surface 15 delimiting the aperture of the ring 11 or 12, a coating of a gripping or adhesive material. In another embodiment, which is not illustrated, the rings are equipped with magnets, as is the inner surface of the pocket, thereby allowing removable fixing of the rings in the pocket by a magnetic connection. It is readily clear that such a type of magnetic connection also serves to fix the bottle holder on a belt, or another support, for example a harness, a backpack strap or an item of clothing.

In the embodiment illustrated in FIG. 4, a third wedging member 100 is inserted in a removable manner into the pocket when the two wedging members 11, 12 are in place in said pocket. The wedging member 100 makes it possible, by virtue of its shape, to retain and to wedge a bottle having dimensions smaller than those of a bottle usually inserted into the pocket. In particular, the member 100 serves to retain a bottle 40 having a diameter which is less than that of a bottle as standardly used. For that purpose, the member 100 is made of a flexible material, for example from the same material as the wedging members 11, 12. In a variant, it is made of a different material. The member 100 is elongate and hollow, with a bottom 101 which is solid in the example, and an open end 102. In other words, it is adapted, externally, to the pocket 3 and, internally, to the shape of the bottle 40. Here, it has an overall cylindrical outer shape with a circular base.

Its internal volume V100 defines a reception volume, which is also cylindrical in the example, having a shape and dimensions adapted to those of a bottle 40. The outer surface 103 of the member 1 is provided with two housings 104, 105 having shapes which are respectively complementary to those of the members 11, 12. In this case, the housings 104, 105 are circular, continuous and parallel grooves. The distance between the housings 104, 105 corresponds to the distance between the members 11 and 12. The edge 106 of the opening 102 of the member 100 is configured with a return. It thus defines a housing 107, in the form of a circular groove for the reception of the end 108 of the pocket 3 which defines the opening 5 thereof. Thus, when the member 100 is inserted into the pocket, it is held in place by the members 11 and 12 and the opening 102 is maintained in the use configuration, that is to say with a nominal useful diameter corresponding to that of the bottle 40, by the end 108 inserted into the groove 107. In a variant, the wedging member 100 is in multipart form and/or does not have a solid bottom. The member 100 can be equipped with a ring for immobilizing the neck of the bottle 40. Similarly, the inner surface of the member 100 can receive a set of other removable wedging members. For that purpose, the inner surface of the member 100 is provided with self-gripping bands and/or magnets in the case of a magnetic connection. In another embodiment, the outer surface of the member 100 is equipped with at least one magnet adapted to produce a removable magnetic connection with at least one wedging member 11, 12 in place in the pocket. it is clear in this case that the member 100 is, where appropriate, not provided with a reception housing 104, 105 for the wedging members 11, 12, the magnetic connection being sufficient to hold in place the member 100 and the members 11, 12 in place in the pocket. Of course, in this case, the shape of the wedging member 100 is adapted.

In one embodiment, which is not illustrated, the wedging members are not in the form of a continuous ring but a discontinuous ring or in the form of parallel tabs. In this case, a variable number of wedging members are arranged on the inner surface 13, for example in a staggered formation and at different heights, orienting them for example over the height H of the pocket 3.

With such a bottle holder, it is easy to maintain in position bottles having shapes and/or dimensions which are other than cylindrical with a circular base, whatever the position of the bottle holder on a belt or another support, while ensuring that the user can easily and blindly insert and take hold of the bottle.

The invention claimed is:

1. A bottle holder (2) comprising a pocket (3) provided with an insertion opening (5; 102) designed to receive a bottle (4; 40) in the pocket (3) of the bottle holder, the opening (5; 102) of the pocket (3) having the same dimensions as the cross section (D) of the pocket (3), at least two removable wedging members (11, 12; 100) are mounted on at least part of the inner surface (13) of the pocket and the two wedging members are configured as continuous rings (11, 12), wherein a third removable wedging member (100) is inserted into the pocket (3) when the two wedging members (11, 12), configured as continuous rings, are in place in the pocket (3) and wherein the third wedging member (100) is provided, on its outer surface, with housings (104, 105) for the reception of the two wedging members (11, 12) configured as rings.

2. The bottle holder as claimed in claim 1, characterized in that the wedging members configured as rings (11, 12) have the same height.

3. The bottle holder as claimed in claim 1, characterized in that the wedging members configured as rings (11, 12) have different heights.

4. The bottle holder as claimed in claim 1, characterized in that the third wedging member (100) has a shape adapted to define, once in place in the internal volume of the pocket, a volume (V100) for the reception of a bottle (40), said volume (V100) being less than the initial volume of the pocket (3).

5. The bottle holder as claimed in claim 1, characterized in that the third wedging member (100) is provided, at an open end (102), with an edge (106) with a return adapted (107) to cover in a removable manner the edge (108) of the opening (5) of the pocket (3) when the third wedging member (100) is in place in the pocket (3).

6. The bottle holder as claimed in claim 1, characterized in that the pocket (3) of the bottle holder (2) is provided with an open bottom (8).

7. The bottle holder as claimed in claim 6, characterized in that at least one strap (9) is fixed in the open bottom (8) of the pocket (3).

8. The bottle holder as claimed in claim 1, characterized in that the pocket of the bottle holder (2) is provided with a closed bottom.

* * * * *